US006132268A

United States Patent [19]

Uchino et al.

[11] Patent Number: 6,132,268

[45] Date of Patent: Oct. 17, 2000

[54] HYDROPLANE WITH A TRANSVERSELY MOUNTED FOUR-CYCLE ENGINE AND SPACE SAVING INTAKE AND EXHAUST SYSTEM CONFIGURATION

[75] Inventors: Takaaki Uchino; Yasuaki Yatagai, both of Hamamatsu, Japan

[73] Assignee: Suzuki Motor Corporation, Shizuoka-Ken, Japan

[21] Appl. No.: 09/130,112

[22] Filed: Aug. 6, 1998

[30] Foreign Application Priority Data

Sep. 24, 1997 [JP] Japan ..... 9-258825

[51] Int. Cl.[7] ..... B63H 11/08

[52] U.S. Cl. ..... 440/38; 440/75; 440/88; 440/89; 440/111

[58] Field of Search ..... 440/111, 88, 89, 440/75, 38; 114/55.5, 55.57

[56] References Cited

U.S. PATENT DOCUMENTS 5,846,102 12/1998 Nitta et al. ..... 440/111

5,967,861 10/1999 Ozawa et al. ..... 440/88

FOREIGN PATENT DOCUMENTS 7-237586 9/1995 Japan .

7-237587 9/1995 Japan .

7-237588 9/1995 Japan .

8-26185 1/1996 Japan .

8-49596 2/1996 Japan .

8-53098 2/1996 Japan .

*Primary Examiner*—Sherman Basinger

*Attorney, Agent, or Firm*—Darby & Darby

[57] ABSTRACT

A hydroplane has a four-cylinder, four-cycle engine of a water cooled type and a jet pump mounted within the hull. The crankshaft of the four-cycle engine is arranged extending transversely across the hull, and the cylinders of the four-cylinder engine are arranged perpendicularly to the impeller shaft of the jet pump.

2 Claims, 6 Drawing Sheets

HYDROPLANE WITH A TRANSVERSELY MOUNTED FOUR-CYCLE ENGINE AND SPACE SAVING INTAKE AND EXHAUST SYSTEM CONFIGURATION

BACKGROUND OF THE INVENTION (1) Field of the Invention

The present invention relates to a hydroplane that is propelled by the jet of water ejected rearward by the rotation of an impeller.

(2) Description of the Prior Art

A typical small-type hydroplane has a two-cycle engine and a jet pump (both not illustrated) mounted in its hull and can move in the predetermined direction by driving the two-cycle engine so as to power the jet pump. The reason for the mounting of a two-cycle engine in the hull is based on the fact that it needs neither an oil pan mechanism nor valve gear mechanism and it is of light weight and compact and can produce a high specific power, all of these features making it suitable for small-type hydroplanes.

However, a two-cycle engine has a large fuel consumption and exhausts a large amount of hydrocarbons (to be abbreviated as HCs hereinbelow) so that it is not a good way to respond to requests for prevention of air, river, lake and sea pollution. In recent years, four-cycle engines, which have a reduced fuel consumption and exhaust a lower amount of HCs, have been developed and improved by raising the revolution speed, increasing the engine displacement and using a multicylinder configuration in order to ensure output power comparable to that of two-cycle engines as well as to prevent environmental pollution. In particular, the effect of raising the revolution speed of four-cycle engines, has made the realization of compact, light-weight, high power four-cycle engines possible.

Prior art concerning hydroplanes of this type are found in Japanese Patent Application Laid-Open Hei 7 No.237,586, Japanese Patent Application Laid-Open Hei 7 No.237,587, Japanese Patent Application Laid-Open Hei 7 No.237,588, Japanese Patent Application Laid-Open Hei 8 No.26,185, Japanese Patent Application Laid-Open Hei 8 No.49,596 and Japanese Patent Application Laid-Open Hei 8 No.53,098.

As stated above, the conventional hydroplanes use four-cycle engines which have been developed and improved by raising the revolution speed and increasing the engine displacement and by using a multicylinder configuration in order to ensure output power comparable to that of two-cycle engines. Since a four-cycle engine needs a large engine space, the intake and exhaust systems of the four-cycle engine need to be arranged in an ideal geometry, in order to realize this configuration. Further, an exhaust system usually has a water jacket to cool it down for safety because otherwise the exhaust system would be elevated in temperature due to the exhaust gas. For this reason, the exhaust system tends to become bulky and heavy. However, conventional hydroplanes have an engine room adequate only for mounting a two cycle engine. Therefore, it has been very difficult to not only arrange the intake and exhaust systems in an ideal manner but also reliably hold this bulky, heavy exhaust system.

SUMMARY OF THE INVENTION

The present invention has been devised in view of the above conventional problems, and it is therefore an object of the present invention to provide a hydroplane in which the intake and exhaust systems of a four-cycle engine are ideally arranged with the exhaust system fixed in a reliable manner.

In order to achieve the above object, the present invention is configured as follows:

In accordance with the first aspect of the invention, a hydroplane comprising an engine and a jet pump mounted on the hull to propel itself by running the engine to power the jet pump, is characterized in that the crankshaft of the engine is arranged transversely across the hull, and the cylinders of the engine are arranged approximately perpendicular to the impeller shaft of the jet pump.

In accordance with the second aspect of the invention, the hydroplane having the above first feature is characterized in that the power transmission mechanism for transmitting the rotational driving force of the crankshaft to the impeller shaft whilst changing the direction of the force is provided to the rear of the crankshaft in the hull.

In accordance with the third and fourth aspects of the invention, the hydroplane having the above first or second feature, is characterized in that the intake system of the engine is arranged in front of the crankshaft within the hull and the exhaust system of the engine is provided to the rear of the crankshaft within the hull while the exhaust system is disposed above the crankcase of the engine.

In accordance with the first feature of the invention, it is possible to lay out the intake system through the exhaust system of the engine approximately in a straight line, thus making it possible to reduce the intake and exhaust resistance. Further, the attenuation of the intake and exhaust pulsation and the intake and exhaust inertia inside the intake and exhaust pipes can be reduced so that the intake and exhaust pulsation effects as well as the intake and exhaust inertia effects can be utilized as fully as possible.

In accordance with the second feature of the invention, it is possible to shorten the distance between the output port of the engine and the jet pump and hence reduce the length of the shaft for connecting these.

In accordance with the third and fourth features of the invention, the exhaust system can be supported and fixed using the exhaust port, the crankcase, the engine mounting frame, the engine bracket and the like. This configuration facilitates steady fastening of the exhaust system with the cylinder head, the crankcase and/or the engine mounting frame.

DESCRIPTION OF THE PREFERRED EMBODIMENTS

Figure 1:
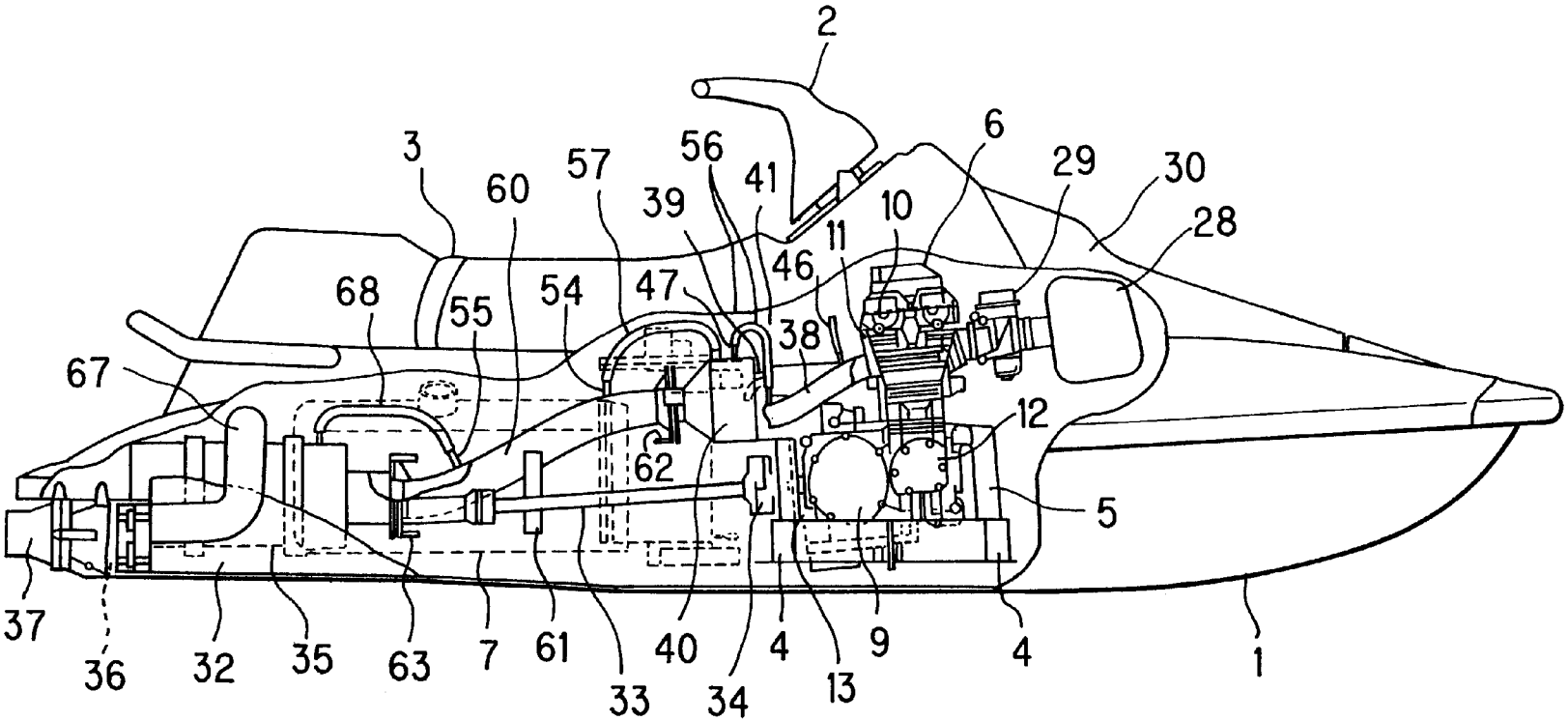
FIG. 1 is a sectional side view showing the embodiment of a hydroplane in accordance with the invention.

The embodiment of the invention will hereinafter be described in detail with reference to the accompanying drawings. The hydroplane in this embodiment comprises: a hull 1; a water-cooled, four-cylinder, four-cycle engine 6 and a jet pump 32 mounted in the hull. A crankshaft 12 of four-cylinder engine 6 is oriented transversally across hull 1 while cylinders 11 of four-cylinder engine 6 are oriented perpendicularly to an impeller shaft 33 of jet pump 32. Exhaust manifold pipes 38 are connected at their upstream end to individual exhaust ports of the cylinders of four-cylinder engine 6 and connected at their downstream end forming an outlet 39, to a joint pipe 40, which is in turn is connected to an exhaust pipe 60 which is connected to a muffler 64.

Hull 1 is integrally formed by a molding of synthetic resins, and as shown in FIG. 1, it has steering handlebars 2 rotatably attached at an upper central site nearer to the front, a strapped-on seat 3 in the upper rear portion and a pair of foot rests integrally formed therewith, on both sides of seat 3, so that an unillustrated rider can straddle seat 3 and control steering handlebars 2 as desired to thereby drive the craft skimming-wise over the water surface.

Figure 2:
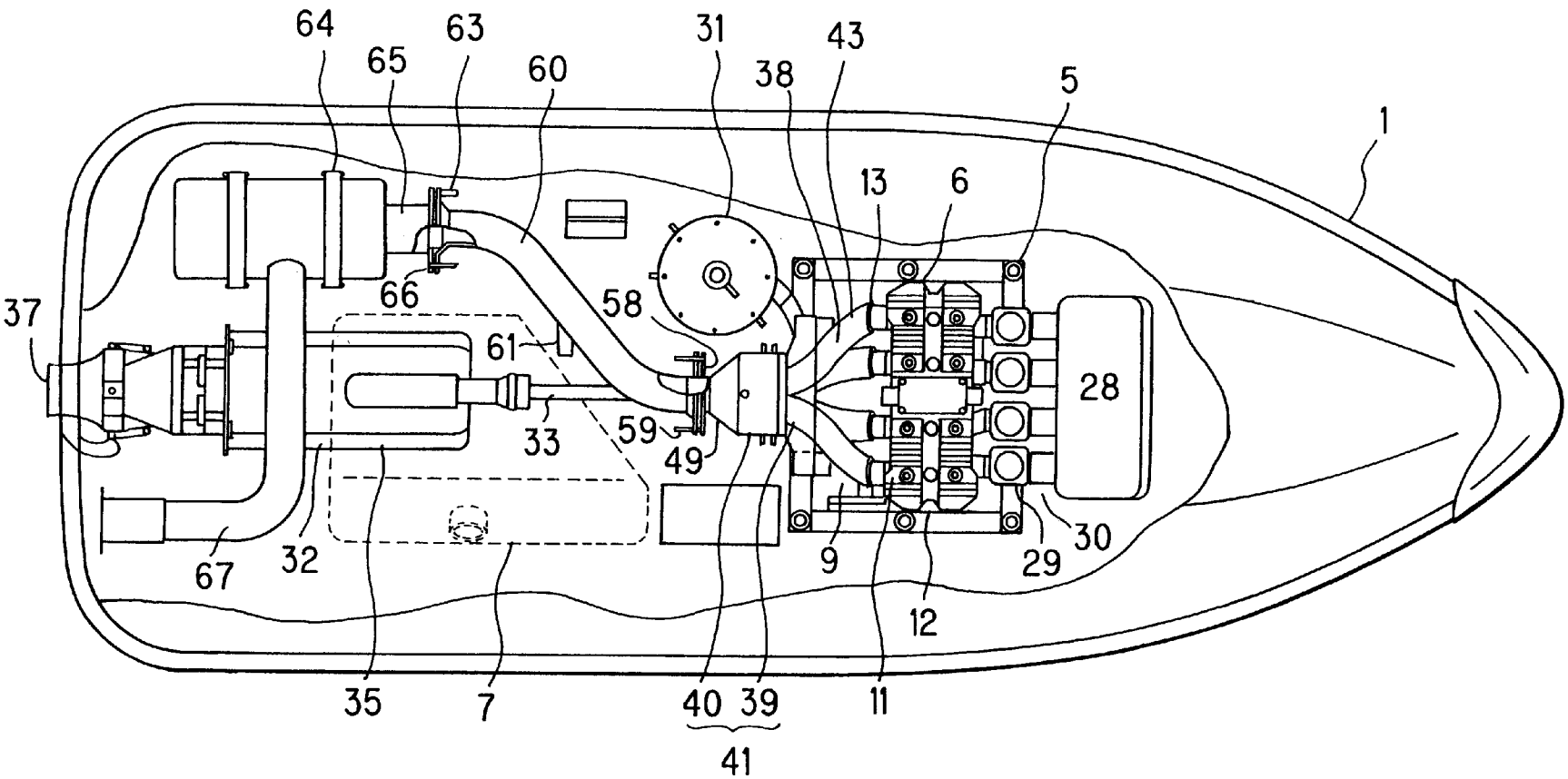
FIG. 2 is a sectional plan view showing the embodiment of a hydroplane in accordance with the invention.

The structure of hull 1 is configured so as to take into account, directional stability, the inhibition of reaction force, etc. and has an engine room at a site displaced forward of the interior central portion to some degree, as shown in FIG. 2. A large-sized in-line four cylinder engine 6 is mounted in an upright manner in the engine room via a plurality of rubber mounting pieces 4 and a box-like mounting frame 5. Provided to some degree in the rear part of the interior central portion of hull 1 is a fuel tank 7 for supplying fuel to four-cylinder engine 6 while a jet pump 32 is placed and oriented in the longitudinal direction of hull 1, in a pump room near the rear portion of the interior center.

The engine room is configured so that air is drawn through a multiple number of unillustrated air ducts. Four-cylinder engine 6, as shown in FIGS. 1 and 2, has a crankcase 9 in the lower part thereof and a cylinder bloc disposed above the crankcase, composed of cylinders 11 arranged in an upright manner and cylinder heads 10. A crankshaft 12 is rotatably supported by a plurality of bearings inside crankcase 9. This crankshaft 12 is linked via a drive gear 14 with a power-direction varying mechanism 13 inside crankcase 9. This power-direction varying mechanism 13 transmits the rotational power from crankshaft 12, changing the power direction by 90° as well as reducing the speed of rotation.

Figure 3:
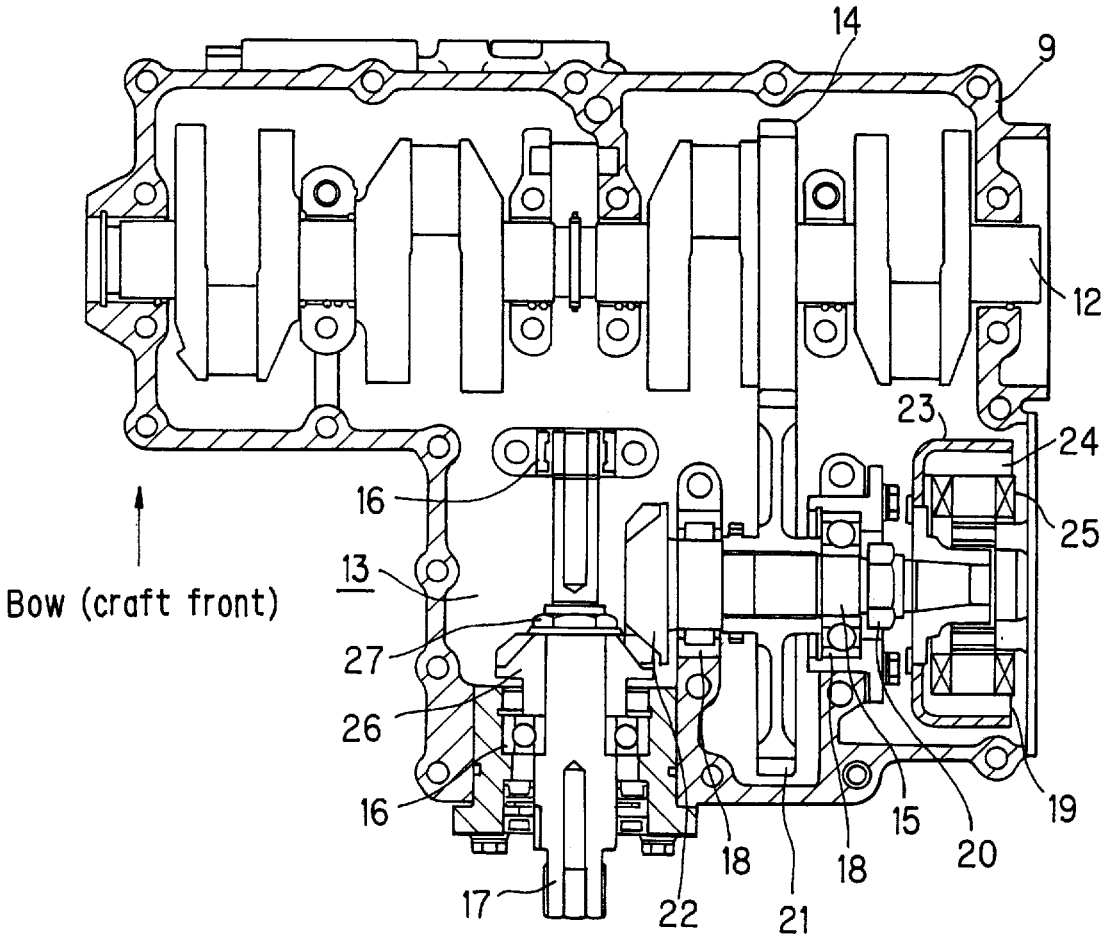
FIG. 3 is a sectional plan view showing an engine used in the embodiment of a hydroplane in accordance with the invention, part of which is simplified.
Figure 4:
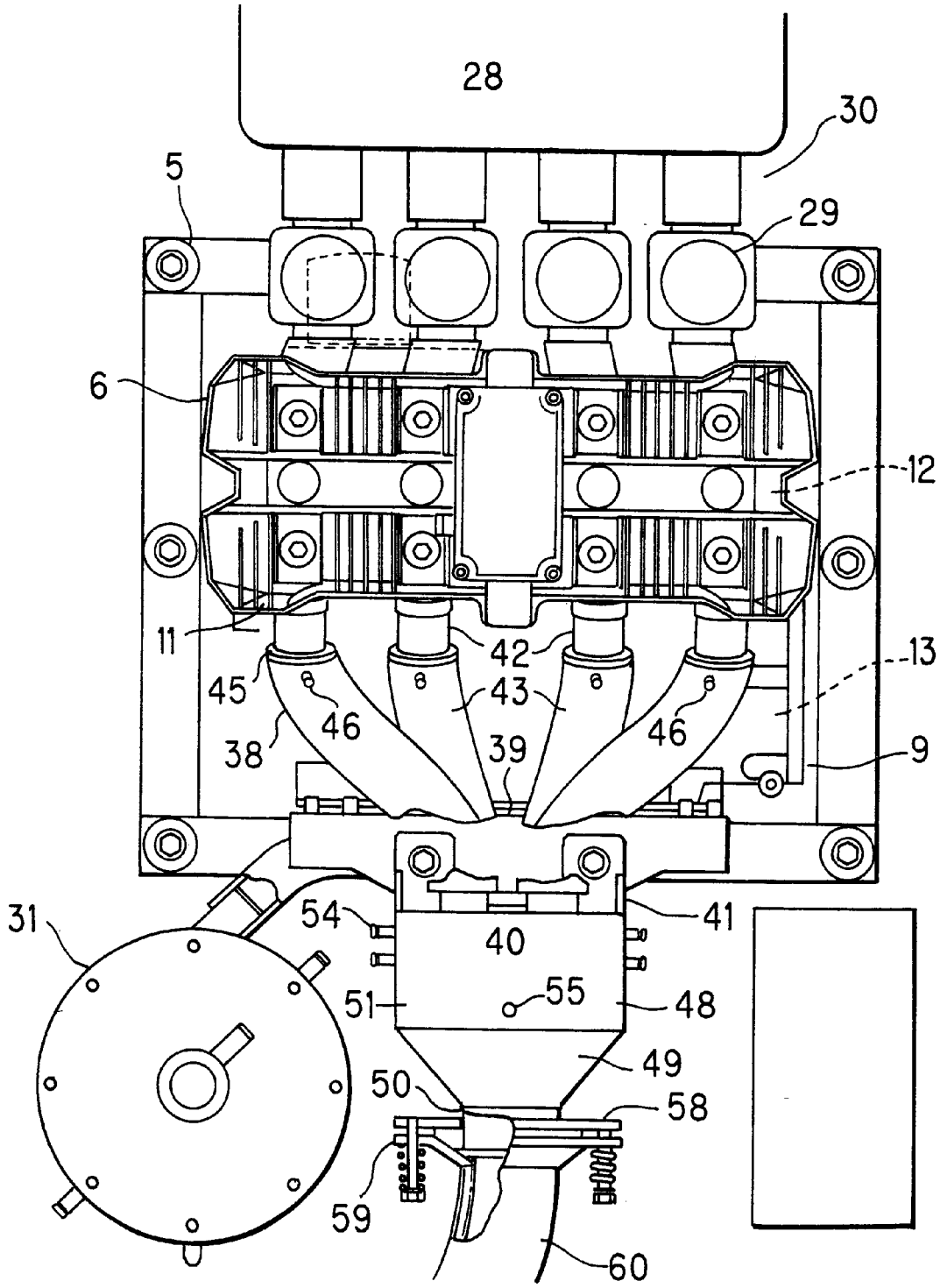
FIG. 4 is a plan view showing an engine, exhaust manifold pipes and a joint pipe in the embodiment of a hydroplane in accordance with the invention.

Power-direction varying mechanism 13, as shown in FIG. 3, comprises: a drive gear 14 fitted on one end of crankshaft 12; a drive shaft 15 rotatably supported in parallel with crankshaft 12; and a driven shaft 17 extending from the core of the internal center of crankcase 9 to the rearward and rotatably supported by a plurality of bearings 16. Drive shaft 15 is rotatably supported by a plurality of bearings 18 on one side of the rear interior portion of crankcase 9. A magneto 19 is provided on the drive shaft 15 on one end thereof, a driven gear 21 meshing with drive gear 14 is fitted in the center of the shaft via a nut 20, and a drive bevel gear 22 is fitted at the other end of the shaft.

As shown in FIG. 3, magneto 19 has a flywheel 23 attached on drive shaft 15. Provided in the inner periphery of flywheel 23 is a permanent magnet 24 having N and S poles arranged alternately. Flywheel 23 further incorporates a magneto coil 25 facing permanent magnet 24. Driven shaft 17 has a driven bevel gear 26 fitted thereon with a nut 27. This driven bevel gear 26 and drive bevel gear 22 are in mesh with each other.

Four-cylinder engine 6 having thus configured power-direction varying mechanism 13 is of a transversally mounted in-line type, i.e., cylinders 11 being arranged transversely across hull 1, instead of a lengthwise mounted type as in conventional configurations. Mounted in the forward upper portion above the center line of crankshaft 12 is an intake system 30 of an air box 28 and carburetor 29 while an oil tank 31 for oil lubrication, connected to four-cylinder engine 6 via an oil pipe is mounted on one side in the rear of the central line of crankshaft 12. Thus, the relatively ample room in respect to the lengthwise direction is markedly more efficiently used. Here, oil tank 31, together with a pump for oil-inflow and oil-return, is adapted to constitute part of the dry sump system, so as to lower the center of gravity of four-cylinder engine 6 as well as to ensure an improved cooling performance.

As shown in FIGS. 1 and 2, jet pump 32 has an impeller shaft 33 of stainless steel, positioned on a slant along the central line of hull 1. This impeller shaft 33 is joined to driven shaft 17 of power-direction varying mechanism 13 through a coupling 34 made up of rubber. Fitted to the end of impeller shaft 33 is an impeller 36 rotating inside a casing 35 so that the rotation of this impeller 36 sucks water from an opening in hull 1 to eject the water rearward from a nozzle 37.

A stator (not shown) is fixed inside casing 35. Nozzle 37 is adapted to sway in accordance with steering control from steering handlebars 2, so that this swaying enables the steering of the hydroplane to be effected. Further, a cooling water inlet port (not shown) is provided on the ejection side of jet pump 32 so that cooling water is supplied from this cooling water inlet port to multiple exhaust manifold pipes 38.

Multiple exhaust manifold pipes 38 (four in this embodiment) are of almost the same length as shown FIGS. 1, 2, 4 through 6 and are located to the rear of crankshaft 12 and are curvingly connected to the exhaust ports of individual cylinder heads 10 of cylinders 11, and their downstream ends are joined together above crankcase 9 to form a single outlet 39, which passes through and is connected with joint pipe 40. Multiple exhaust manifold pipes 38, together with joint pipe 40, constitute an exhaust system 41, and are supported by mounting frame 5 and are located above crankcase 9.

Each exhaust manifold pipe 38 has a coaxial double-pipe configuration of a longer, inner tube 42 and a relatively shorter, outer tube 43 with a jacket 44 partitioned into sections for the flow of cooling water, formed between the two tubes. Outer tube 43 has nipples 45 at both up- and down-stream ends thereof, and is connected at its upstream end to a cooling water inlet pipe 46 and at its downstream end is connected to a cooling water outlet pipe 47.

Figure 5:
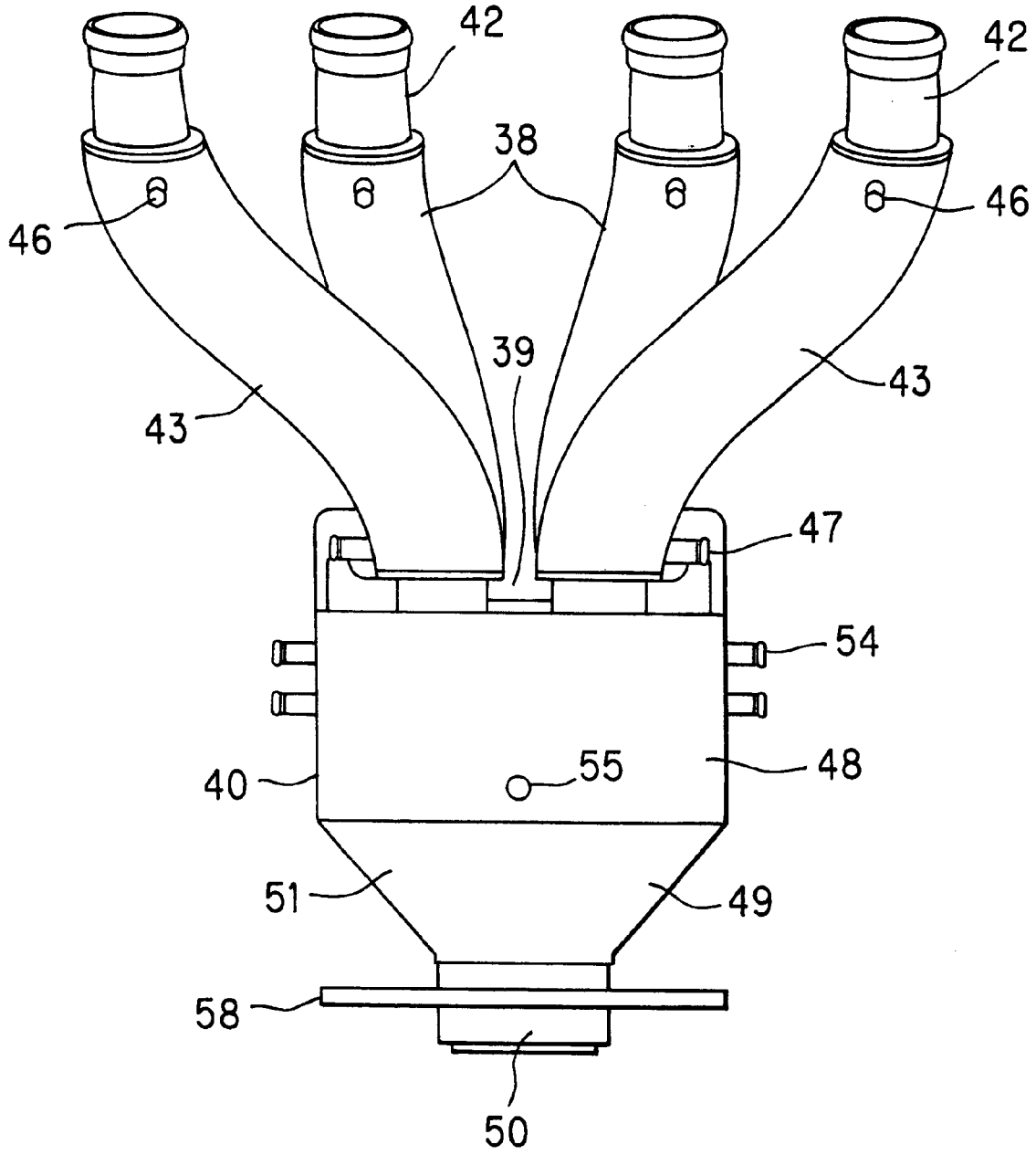
FIG. 5 is a front view showing exhaust manifold pipes and a joint pipe in the embodiment of a hydroplane in accordance with the invention.
Figure 6:
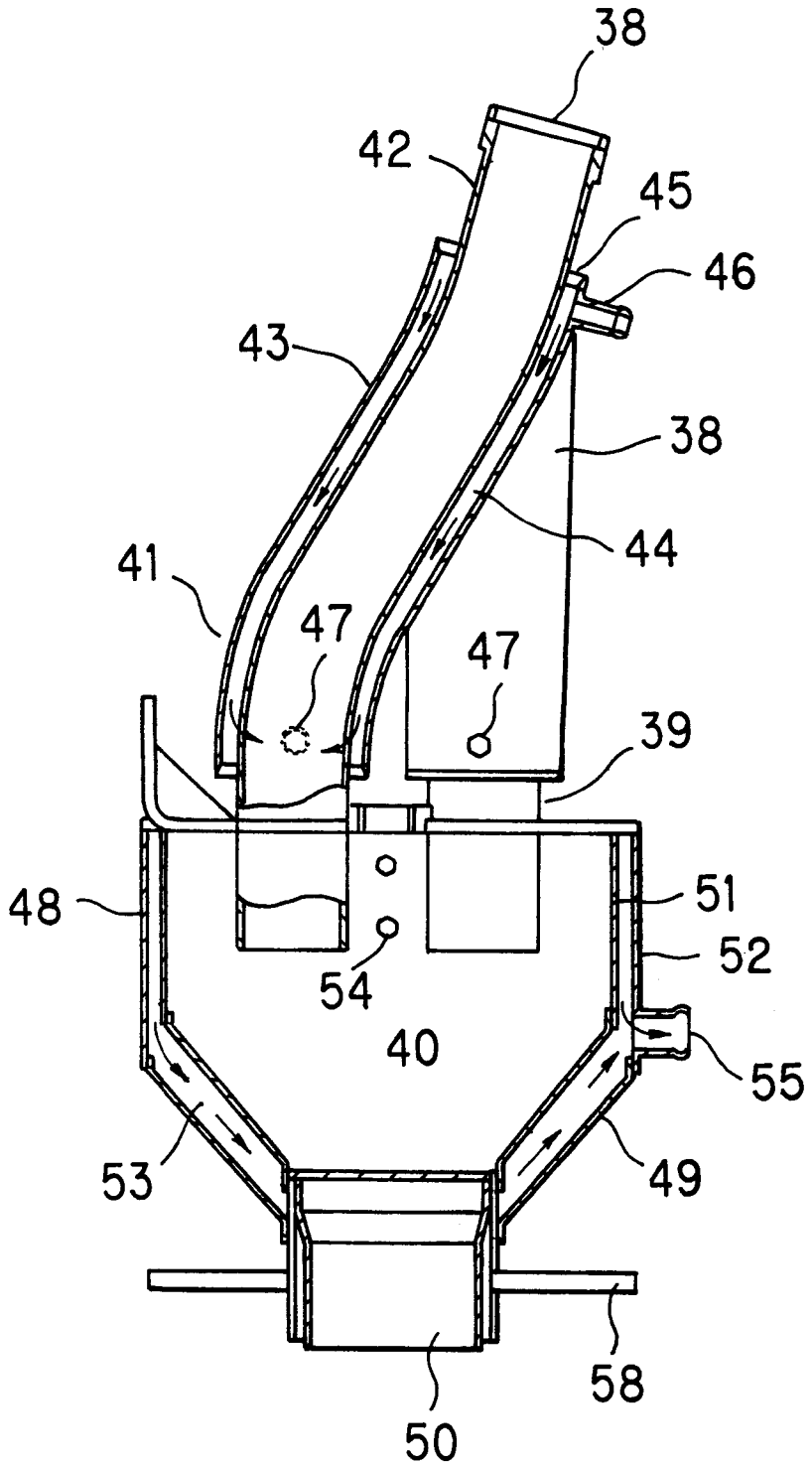
FIG. 6 is a sectional illustrative view of FIG. 5.

Joint pipe 40, as shown in FIGS. 5 and 6, is integrally configured of a large-diametric cylinder portion 48 formed by drawing process for holding multiple exhaust manifold pipes 38 together and allowing them to pass therethrough, a tapered pipe portion 49 which decreases the cross section from the upstream to the downstream end, a small-diametric cylinder portion 50, and is supported by mounting frame 5 so as to be positioned above crankcase 9. Large-diametric pipe portion 48 and tapered pipe portion 49 are formed of a double-wall configuration which is made from an inner shell 51 and an outer shell 52, between which a jacket 53 partitioned into sections is formed for the flow of cooling water. A plurality of cooling water inlet pipes 54 are connected at upstream sites in outer shell 52 of large-diametric pipe portion 48 and a cooling water outlet pipe 55 is connected at a downstream site therein.

Multiple cooling water inlet pipes 54 are connected through communicating pipes 56 to cooling water outlet pipe 47 of exhaust manifold pipes 38. Cooling water outlet pipe 55 is connected to a cooling water inlet pipe 54 of exhaust pipe 60 via a communicating pipe 57. As seen in FIGS. 5 and 6, small-diametric pipe portion 50 is fitted with an attachment joint 58, which is connected to another attachment joint 59 on the upstream portion of exhaust pipe 60 with a spherical gasket and a clamp for resistance to vibration and shock.

Exhaust pipe 60 is formed so as to be flexed sidewards from the center of hull 1 and downwards, from the upstream to the downstream end, and is supported by a support bracket 61 for vibration absorption. Attachment joint 59 for joint pipe 40 is fitted on the upstream end of exhaust pipe 60 while attachment joint 63 is fitted on the downstream end of exhaust pipe 60. This attachment joint 63 is joined to another attachment joint in muffler 64 by means of a special gasket and/or clamp. Exhaust pipe 60 has a coaxial double-pipe configuration, and the space between the inner and outer tubes, in which an unillustrated catalyst is incorporated, forms a jacket partitioned into sections for the flow of cooling water. The outer pipe has nipples at both up- and downstream ends thereof, and is connected at its upstream end to a cooling water inlet pipe 54 and at its downstream end is connected to a cooling water outlet pipe 55.

Further, muffler 64 has multiple number of exhaust compartments (not shown) arranged from the upstream to the downstream end, and is located on one side in the rear of the interior of hull 1, as shown in FIG. 2. These multiple exhaust compartments are adapted to communicate with each other. A connecting tube 65 extending forwards with respect to hull 1 from the upstream exhaust compartment is formed with an attachment joint 66 for mating the attachment joint at the downstream end of exhaust pipe 60. Further, connected to the downstream exhaust compartment is an exhaust hose 67, which crosses over jet pump 32 and is bent in an approximately L-shape to the level of the pump to discharge the exhaust to the rear of the craft. Further, the upstream exhaust compartment is connected to cooling water output pipe 55 of exhaust pipe 60 via a communication pipe 68.

In this arrangement, when a rider straddling seat 3 starts four-cylinder engine 6, power-direction varying mechanism 13 transmits the rotational driving force from four-cylinder engine 6 to impeller shaft 33 as it change the direction of the force. Thus, jet pump 32 is driven so as to drive impeller 36. This impeller 36 draws water from the opening of hull 1 to eject the water rearwards from nozzle 37. This effect of the jet of water causes the hydroplane to skim over the water surface. At this time, the exhaust gas is discharged from the exhaust port of four-cylinder engine 6, passing through, in order of sequence, exhaust manifold pipes 38, joint pipe 40, exhaust pipe 60, and muffler 64, and is exhausted to the outside of the craft from exhaust hose 67 at the stern of hull 1.

As four-cycle engine 6 starts, cooling water, from sea or lake water (indicated by arrows) flows into the cooling water input port, is supplied therefrom, passing through the communicating pipe, to jacket 44 of exhaust manifold pipes 38, jacket 53 of joint pipe 40, the jacket of exhaust pipe 60, in order of sequence, to thereby cool down all the heated elements, i.e., exhaust manifold pipes 38, joint pipe 40, exhaust pipe 60 and the catalyst. The cooling water used to cool exhaust manifold pipes 38, joint pipe 40, exhaust pipe 60 and the catalyst, flows from the jacket of exhaust pipe 60, passing through muffler 64, into exhaust hose 67, and then is discharged out of the craft.

In accordance with the above configuration, since four-cylinder engine 6 is used, the discharge of HCs is markedly reduced compared to that from a two-cycle engine, thus making it possible to achieve effective exhaust gas treatment. Further, since cylinders 11 are arranged approximately perpendicular to the center line of impeller shaft 33, it is possible to dispose intake system 30 and exhaust system 41 approximately in a straight line. Resultantly, it is possible to reduce the intake and exhaust resistance during running of four-cylinder engine 6 and hence markedly improve the charging efficiency of the intake air and the exhaust efficiency. Further, since intake system 30 and exhaust system 41 are laid out approximately in a straight line, the attenuation of the intake and exhaust pulsation and the intake and exhaust inertia inside the intake and exhaust pipes can be reduced so that the intake and exhaust pulsation effects as well as the intake and exhaust inertia effects can be utilized as fully as possible. Thus, this utilization will markedly improve the output power of four-cylinder engine 6.

Further, since intake system 30 and exhaust system 41 are arranged approximately in a straight line in the longitudinal direction of hull 1 in which ample room can be taken, the intake pipe, exhaust manifold pipes 38 and exhaust pipe 60 can be made longer so as to achieve a sharp improvement of the output power of four-cylinder engine 6. Based on these effects, a four-cycle engine can be improved into a high-speed and high-power type, gaining an advantage as to its performances over a conventional two-cycle engine. Further, since power-direction varying mechanism 13 of a bevel gear type is placed in the rear of crankshaft 12 in hull 1, it is possible to shorten the distance between the output end of four-cylinder engine 6 and jet pump 32, and hence the impeller shaft 33 used for joining these can be a short one. This reduction in the length of impeller shaft 33 makes it possible to reduce the whole weight of the watercraft as well as its cost. Further, this also can inhibit the bending vibration and torsional vibration of impeller shaft 33.

Since the heavy load, i.e., exhaust system 41 is laid out above crankcase 9, crankcase 9, engine mounting frame 5, engine bracket 61 and the like, in addition to the exhaust port, can be used for supporting this exhaust system 41. Accordingly, steady fastening of exhaust system 41 with cylinder head 10, crankcase 9 and/or engine mounting frame 5 can be achieved, so that it is possible to prevent reduction of durability due to the vibration of four-cylinder engine 6 and due to hull vibration during running. Further, since heavy fuel tank 7 and oil tank 31 are laid out in the rear of crankshaft 12 with exhaust system 41 interposed between fuel tank 7 and oil tank 31, the maneuverability as well as balance can be markedly improved.

Although the above embodiment has been illustrated with the case of four-cylinder engine 6, the invention should not be limited to this. For example, an engine of two cylinders, three cylinders or five or more cylinders can be used. It is also possible to mount one of fuel tank 7 and oil tank 31 in the rear of crankshaft 12. The feature and configuration of power-direction varying mechanism 13 may be modified as appropriate. Further, cylinders 11 may be arranged exactly perpendicular to impeller shaft 33, or may be arranged approximately perpendicular thereto. Further, the number of exhaust manifold pipes 38, and/or the number of support brackets 61 as well as the number of catalysts can be increased or decreased as appropriate.

The length of multiple exhaust manifold pipes 38 can be varied as appropriate. Other cooling fluids can be used as appropriate. Exhaust manifold pipes 38 and/or joint pipe 40 may be supported by crankcase 9. Joint pipe 40 may be formed of a double pipe configuration. Multiple exhaust manifold pipes 38 are supported by mounting frame 5, they can be supported by the surface of crankcase 9. Joint between pipes can be formed as appropriate of a screwed type, butt welding type, socket welding type, bite type, flare type, etc. It is of course possible to provide either a single cooling fluid ejecting hole or a plurality of ejecting holes, for inner tube 42 and inner shell 51 in which jackets 44 and 53 are formed in a partitioned manner.

As has been described above, in accordance with the first aspect of the invention, it is possible to lay out the intake system and exhaust system of a four-cycle engine, in a proper and ideal manner, effective in reliably holding the exhaust system.

In accordance with the second aspect of the invention, it is possible to shorten the distance between the engine and the jet pump and hence reduce the length of the shaft for connecting these. Further, this reduction in the length of the shaft makes it possible to reduce the whole weight of the watercraft as well as its cost. This also can inhibit the bending vibration and torsional vibration of the shaft.

The third and fourth aspects of the invention are effective in preventing the lowering of the durability due to the vibration of the engine and due to hull vibration during running.

What is claimed is:

1. A hydroplane including a hull and comprising a four-cycle engine and a jet pump mounted on the hull to propel itself by running the engine to power the jet pump, the engine having cylinders and a crankshaft, and the jet pump having an impeller shaft, the crankshaft of the engine being oriented transversely across the hull, and the cylinders of the engine being oriented approximately perpendicular to the impeller shaft of the jet pump, a power transmission mechanism comprising: a drive shaft rotatable supported in parallel with a crankshaft; and a driven shaft rotatably supported and extending rearwardly from a core of an internal center of the crankcase, wherein the drive shaft at the center is fitted with a driven gear in mesh with a drive gear fitted on the crankshaft and a drive bevel gear in mesh with a driven bevel gear fitted on the driven shaft, wherein the power transmission mechanism for transmitting the rotational driving force of the crankshaft to the impeller shaft while changing the direction of the force is provided to the rear of the crankshaft in the hull.

2. The hydroplane according to claim 1, wherein the intake system of the engine is arranged in front of the crankshaft within the hull and the exhaust system of the engine is provided to the rear of the crankshaft within the hull while the exhaust system is disposed above the crankcase of the engine.

* * * * *